US006230942B1

(12) United States Patent
Kuo

(10) Patent No.: US 6,230,942 B1
(45) Date of Patent: May 15, 2001

(54) METERED DISPENSING PUMP DEVICE PREVENTABLE OF WATER PERMEATION

(76) Inventor: Roy Kuo, 3F No. 288 Chin Chow St., Taipei (TW)

( * ) Notice: Subject to any disclaimer, the term of this patent is extended or adjusted under 35 U.S.C. 154(b) by 0 days.

(21) Appl. No.: 09/425,135

(22) Filed: Oct. 21, 1999

(51) Int. Cl.[7] ..... B65D 88/54

(52) U.S. Cl. ..... 222/321.9; 222/481.5; 222/442

(58) Field of Search ..... 222/321.3, 321.7, 222/321.9, 481.5, 442

(56) References Cited

U.S. PATENT DOCUMENTS

| | | | | |
|---|---|---|---|---|
| 3,229,864 | * | 1/1966 | Roder | 222/321.7 |
| 3,844,452 | * | 10/1974 | Blum | 222/321.7 |
| 4,930,670 | * | 6/1990 | Kuo | 222/321.3 |
| 5,549,223 | * | 8/1996 | Hori | 222/321.3 |
| 5,725,128 | * | 3/1998 | Foster | 222/321.9 |
| 5,826,756 | * | 10/1998 | Foster | 222/321.3 |
| 6,006,949 | * | 12/1999 | Foster et al. | 222/321.9 |

* cited by examiner

*Primary Examiner*—Joseph A. Kaufman
*Assistant Examiner*—David Deal
(74) *Attorney, Agent, or Firm*—Pro-Techtor International Services

(57) ABSTRACT

A metered dispensing pump device preventable of water permeation is disclosed and is comprised of a liquid discharging cover, a cap, a liquid storing pipe, a liquid suction valve, a bottle cap, a spring, a valve film and a pipe-like seat. Wherein, the cap is screwed in and locked onto the pipe-like seat. One end of the liquid storing pipe is extended through the cap to connect with the liquid discharging cover, and the other end thereof is connected with the liquid suction valve. The liquid suction valve is loaded with the spring to firmly press the valve film onto the pipe-like seat; thus the metered dispensing pump device is constructed which is locked onto a bottle mouth. When the liquid discharging cover is pressed down, the liquid in the bottle can be easily drawn out of the bottle. By a specific peripheral wall of the liquid storing pipe together with the fact that a tapered pipe of the cap being higher than the cap tightly prevents permeation of water, bathing water can be prevented from permeating into the bottle. Thereby the liquid in the bottle can be protected from pollution of the bathing water.

1 Claim, 6 Drawing Sheets

METERED DISPENSING PUMP DEVICE PREVENTABLE OF WATER PERMEATION

BACKGROUND OF THE INVENTION

1. Field of the Invention

The present invention is related to a metered dispensing pump device preventable of water permeation. The device can be used on various bottles for suction and dispensing of liquid therein. The present invention is especially related to an improved metered dispensing pump device for liquid suction from a bottle loaded with hand washing cream, hair shampoo or shower gel etc. used for bathing. The liquid in the bottle can be protected from permeation and pollution of showering water by the device. And the stability and quality of the chemical liquid in the bottle can thus be well kept.

2. Description of the Prior Art

As is well known, a bottle loaded with normal chemical liquid such as hand washing cream, hair shampoo or shower gel etc. mostly is equipped with a metered dispensing pump device to allow a user to press it for suction of quantitative chemical liquid. Such a bottle loaded with normal chemical liquid such as hand washing cream, hair shampoo or shower gel etc. normally is placed in a watery environment such as in a bath room, especially at the spot under a shower for a user to conveniently press and obtain the chemical liquid for washing hair or body. However, the conventional metered dispensing pump device (as shown in FIG. 1) mounted on the bottle loaded with normal cleaning liquid placed in the watery environment is not water proofing, and water can often permeate into the bottle to influence quality of the chemical liquid.

In the conventional metered dispensing pump device shown in FIG. 1 as an example, when a user presses a liquid discharging knob 1, a piston 22 in a liquid storing pipe 2 full of the liquid is pressed down to approach a pipe-like seat 4 to make the liquid in the liquid storing pipe 2 push away a steel bead 21. Thereby, the liquid is discharged out of the bottle 10 through the liquid discharging knob 1, and an object of taking the liquid in a simple way can be obtained. And by elastic stretching and compressing of a spring 23, the piston 22 and the pipe 2 are pushed upwardly to provide suction, air can get through an air way 33 formed between a wall in a groove 31 of a cap 3 and the liquid storing pipe 2 and through a positioning annulus 32 to release the vacuum state in the bottle 10. Thereby, the liquid in the bottle 10 can propitiously push away a steel bead 41 on a liquid supplying pipe 42 to recharge the pipe 2.

Nevertheless, the above stated conventional metered dispensing pump device can have its groove 31 for receiving the liquid discharging knob 1 been accumulated with bathing water when in showering. When the liquid discharging knob 1 is pressed down, the bathing water accumulated in the groove 31 will get through the positioning annulus 32 and the airway 33 into the bottle 10. This pollutes the liquid in the bottle 10 and makes water therein diluted, makes microbe therein propagate to decay or deteriorate the liquid. These troubles come mainly from the air way 33 formed between the wall in the groove 31 of the cap 3 and the liquid storing pipe 2 and opening downward into the bottle 10 (as shown in FIG. 1). Therefore, it is the motive of the present invention to thoroughly solve these problems.

SUMMARY OF THE INVENTION

In view of the above stated problems of pollution and deterioration of liquid in the bottle, the primary object of the present invention is to prevent permeation of water into the bottle through an air way formed between a wall in a groove and a liquid storing pipe of a metered dispensing pump device when in pressing the device. Thereby an object of protecting the liquid in the bottle from pollution of the exterior bathing water can be obtained.

In order to achieve the above object, the peripheral wall of the liquid storing pipe can be changed to have an obliquity, and a tapered pipe with its pipe mouth much higher than the cap is provided. So that liquid storing pipe having an obliquity can be tightly connected with the higher pipe mouth of the tapered pipe before pressing the metered dispensing pump device to prevent water from permeating, and can form an air way after pressing. The air way is formed at a location higher than the groove which is subjected to accumulation of water, hence bathing water accumulated in the groove will not permeate into the bottle. And chemical quality of the cleaning liquid in the bottle can be protected.

The present invention will be apparent after reading the detailed description of the preferred embodiment thereof in reference to the accompanying drawings.

DETAILED DESCRIPTION OF THE PREFERRED EMBODIMENT

Figure 1:
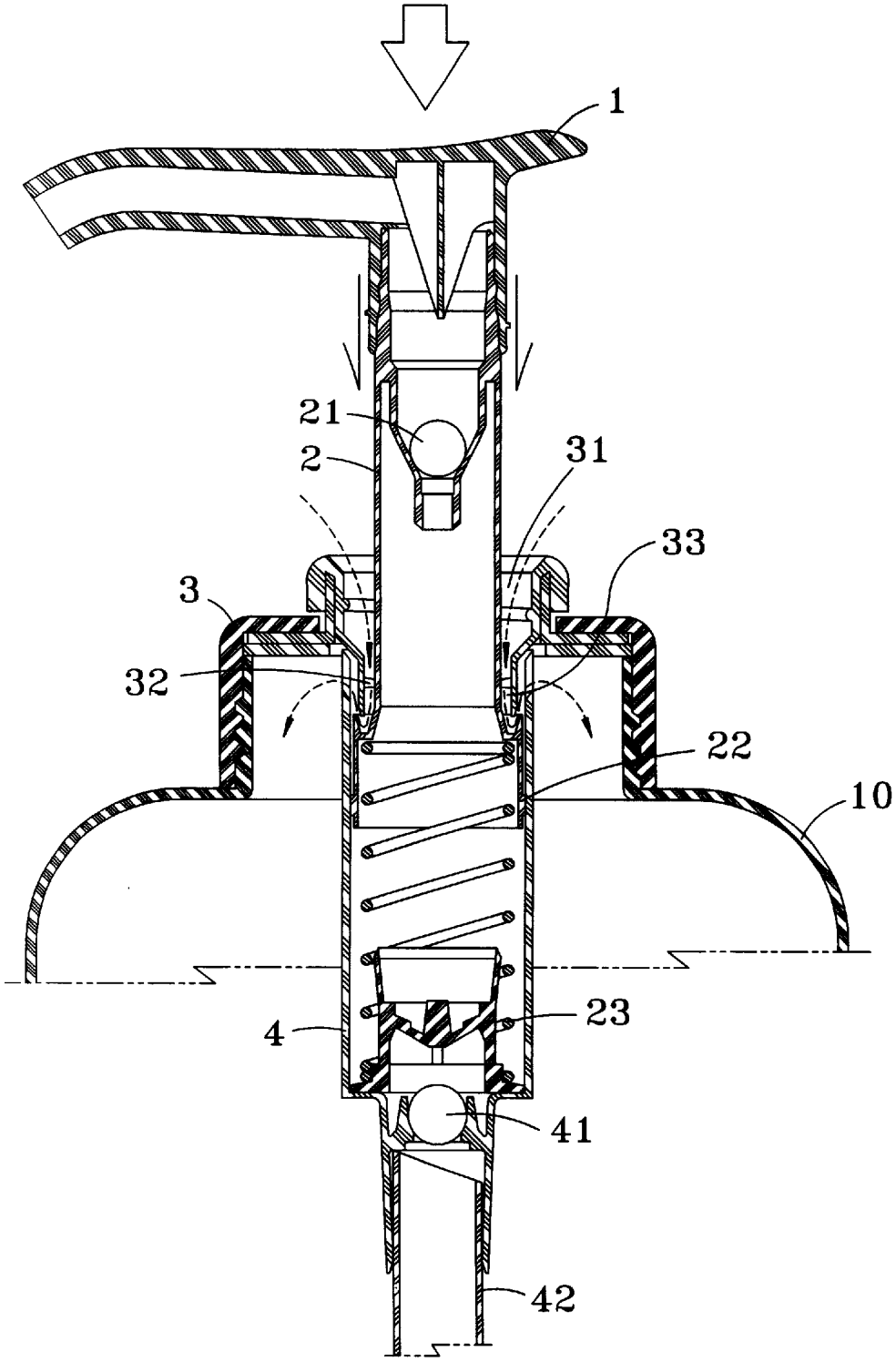
PRIOR ART Fig. 1
FIG. 1 is a sectional view showing pressing of a conventional metered dispensing pump device.
Figure 2:
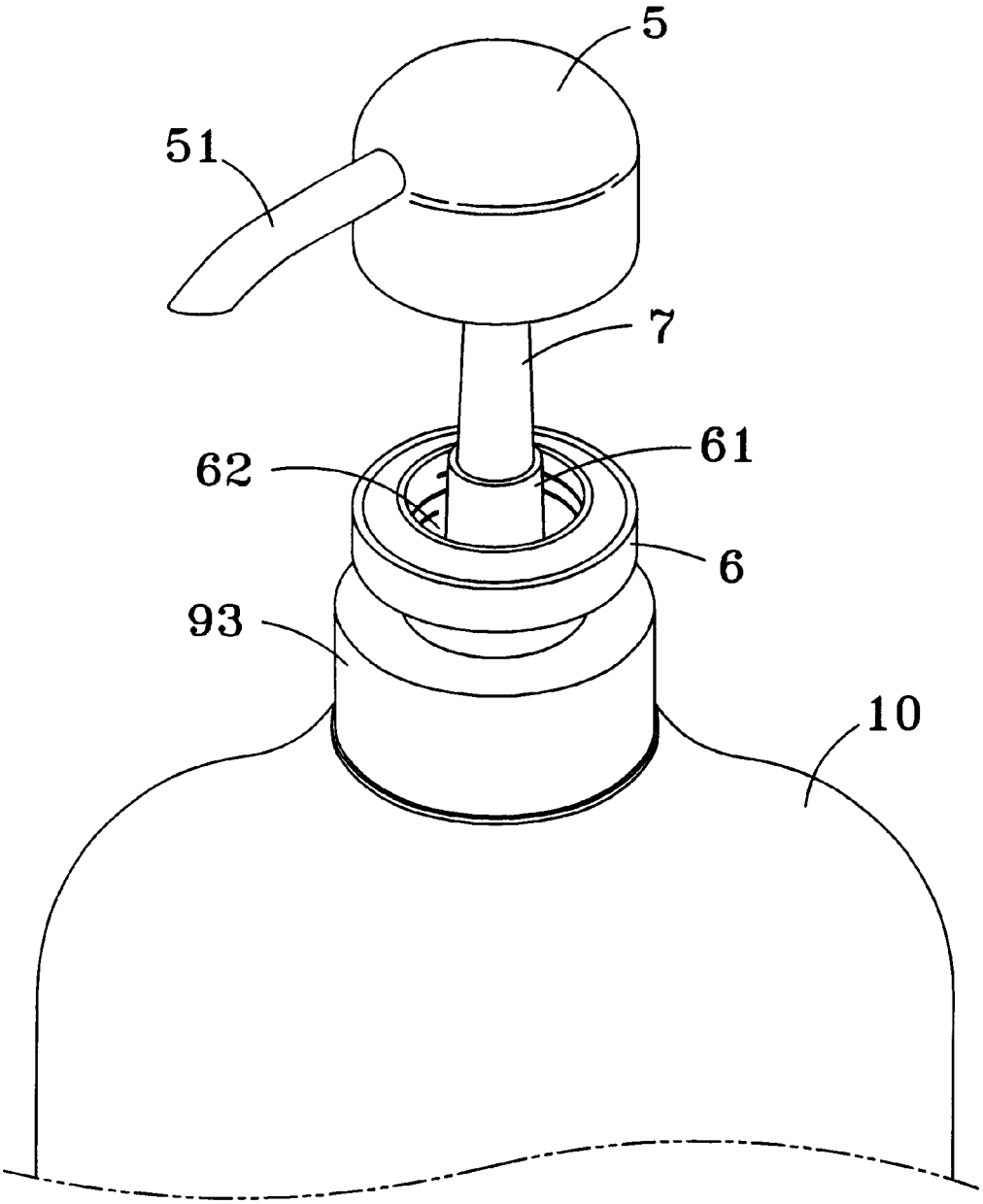
FIG. 2 is a perspective of the present invention.
Figure 3:
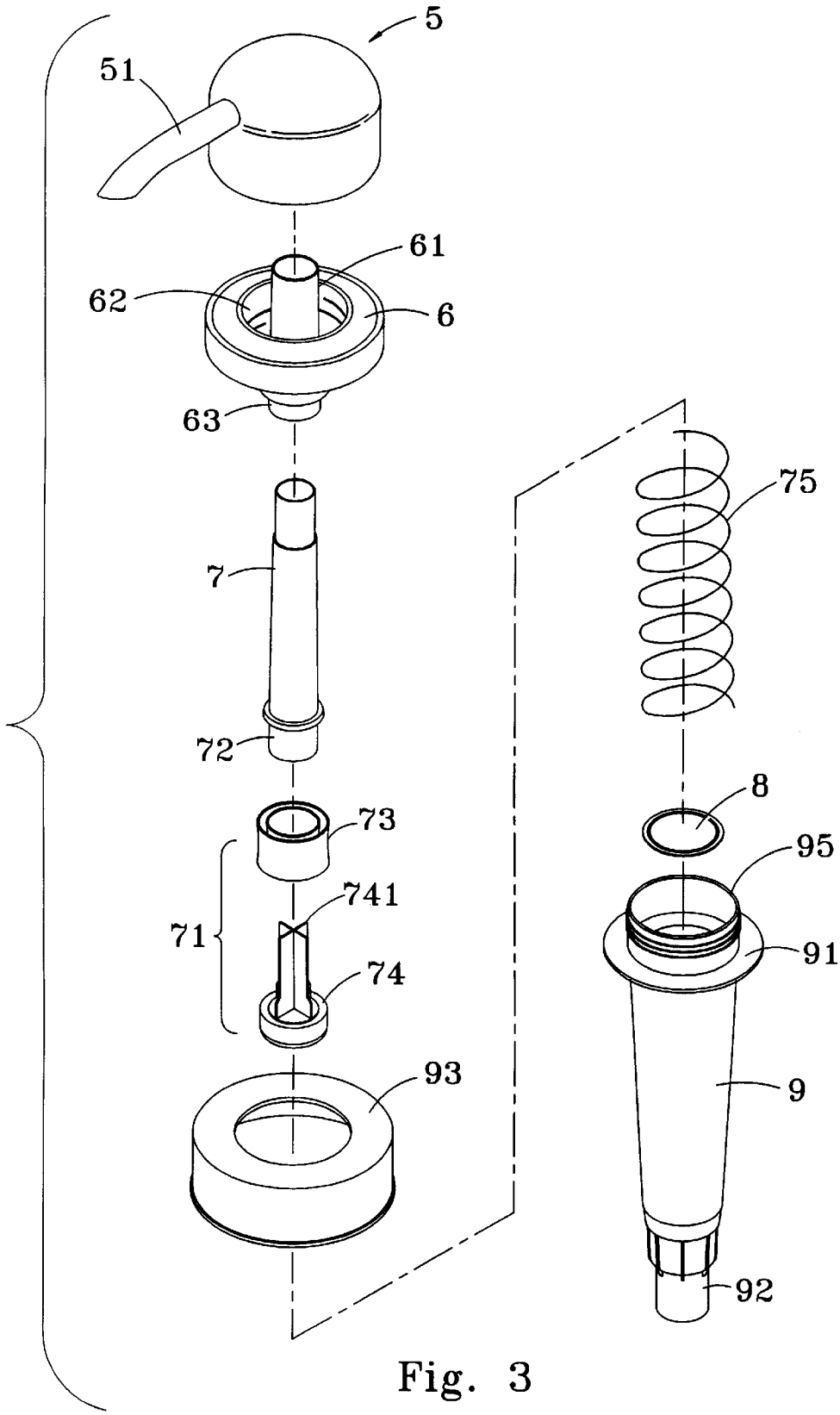
FIG. 3 is an analytic perspective of the present invention.

Referring to FIG. 2 and 3, the metered dispensing pump device preventable of water permeation of the present invention is comprised mainly of a liquid discharging cover 5, a cap 6, a liquid storing pipe 7, a liquid suction valve 71, a bottle cap 93, a spring 75, a valve film 8 and a pipe-like seat 9.

Figure 4:
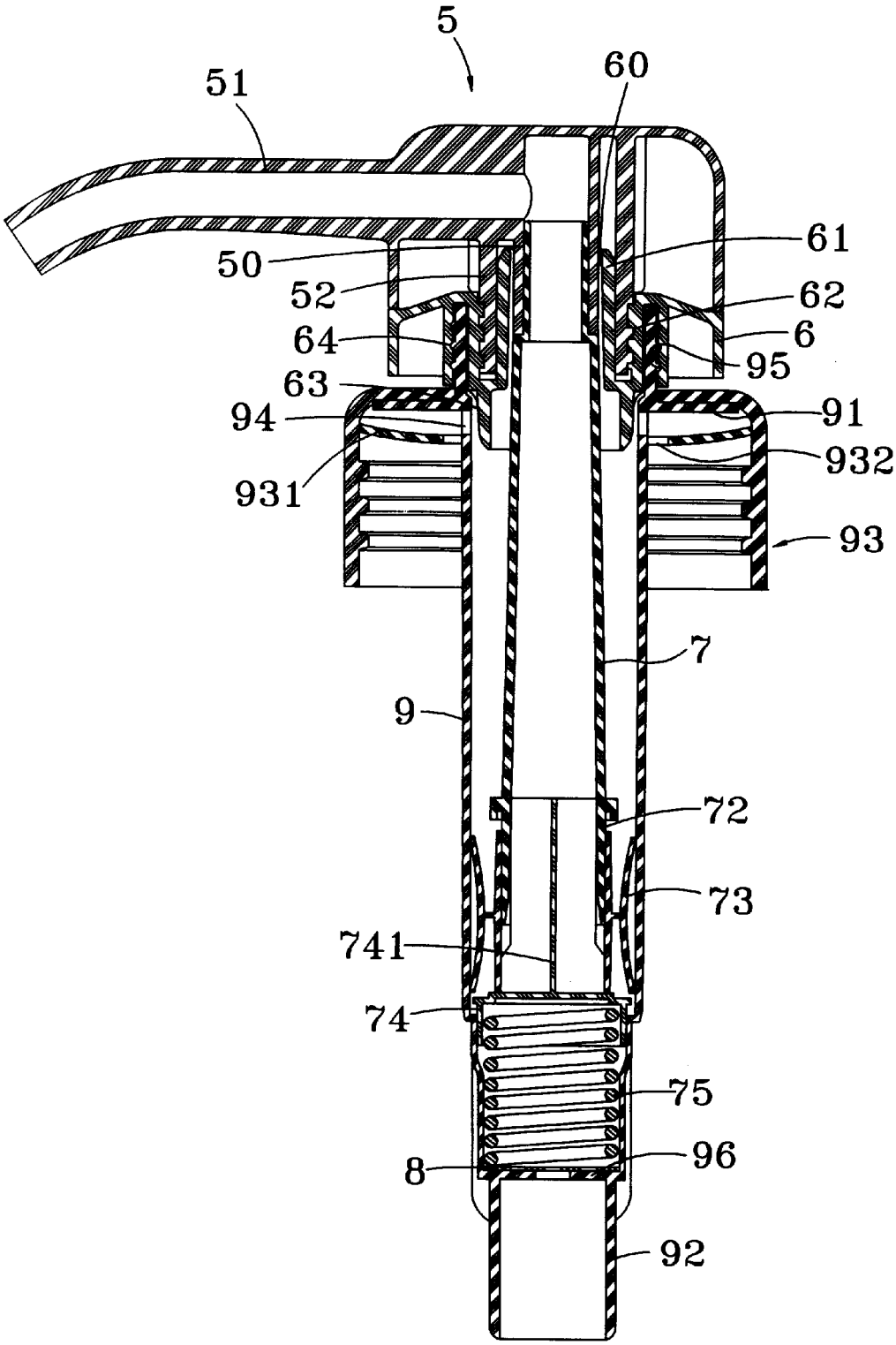
FIG. 4 is a sectional view showing screwing connecting of a liquid discharging cover with the thread on a cap of the present invention.
Figure 5:
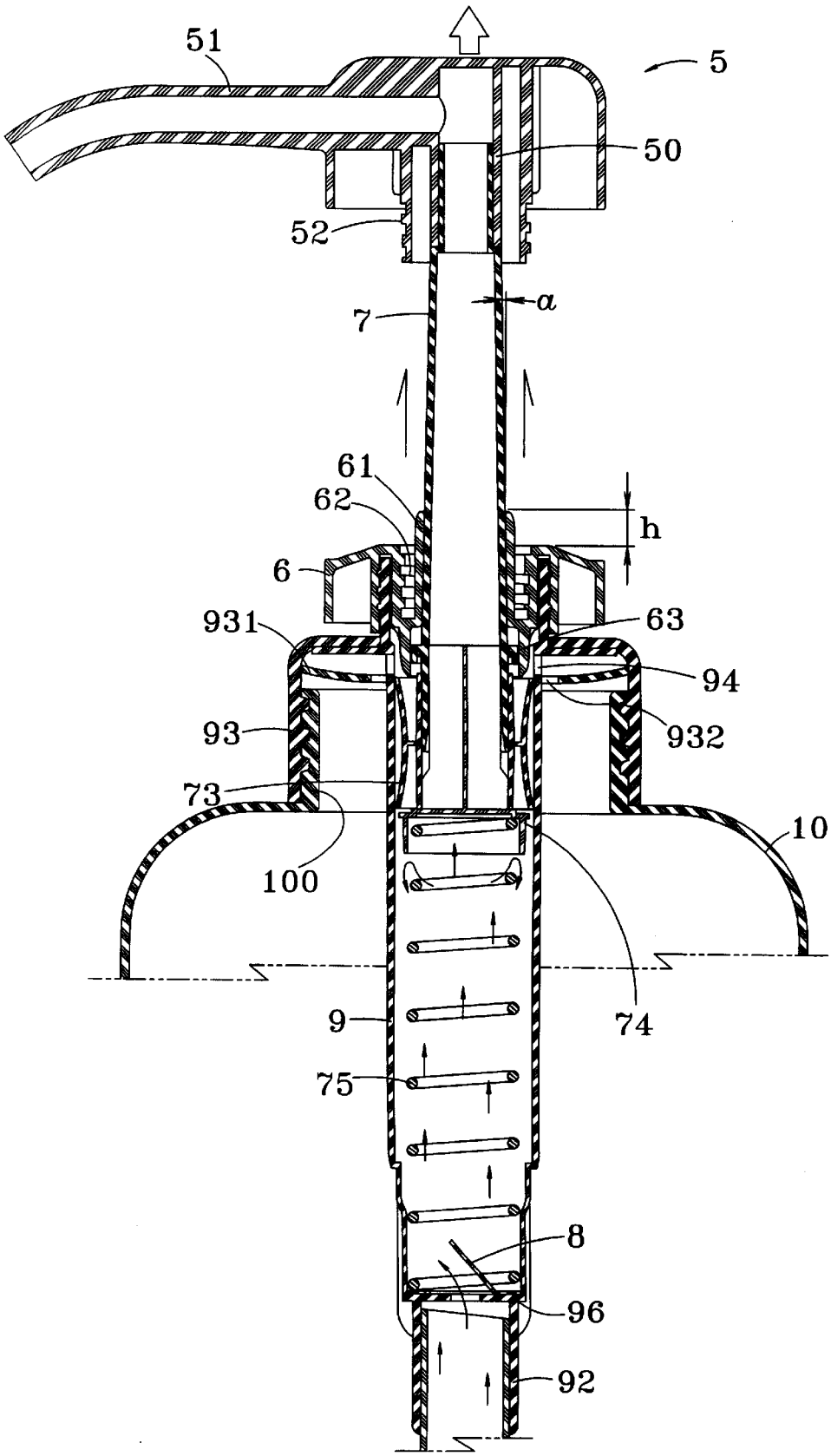
FIG. 5 is a sectional view showing a stretching state of the present invention.

Wherein, the liquid discharging cover 5 is provided with 6 liquid discharging pipe 51, and is provided at the central bottom thereof with a sleeve 50 having a smaller diameter and an external threaded pipe 52 having a larger diameter (as shown in FIG. 5). The sleeve 50 and the liquid discharging pipe 51 are communicated with each other to form a liquid discharging channel. The liquid storing pipe 7 is connected to the sleeve 50 for supplying cleaning liquid to the liquid discharging pipe 51 of the liquid discharging cover 5. The external threaded pipe 52 of the liquid discharging cover 5 is locked onto a thread 62 of the cap 6, so that the liquid storing pipe 7 and liquid storing pipe 7 exposing to the space above the cap 6 originally (as shown in FIG. 5) are restrained. That is, the liquid discharging cover 5 is locked onto the cap 6 after it is pressed down to hide the liquid storing pipe 7, thus the liquid discharging cover 5 and the liquid storing pipe 7 is restrained from raising and exposing (as shown in FIG. 4). Hence profile of the whole bottle is reduced in favor of packaging and shipping.

The cap 6 is made as a whole, one end thereof is provided with a tapered pipe 61 and the thread 62, while the other end thereof is provided with a mouth 63 and an inner threaded portion 64 (as shown in FIG. 4). A groove is formed by the thread 62 and is sealed on the bottom thereof. In which the mouth of the tapered pipe 61 is higher than the cap 6 to have a difference of height "h" (also referring to FIG. 5). And the tapered pipe 61 is communicated with the mouth 63. The thread 62 is matchably locked with the external threaded pipe 52 of the liquid discharging cover 5, so that the latter can be locked onto the cap 6. The mouth 63 can be connected with one end of the liquid storing pipe 7. The inner threaded portion 64 can be screwed in and locked onto a thread 95 on the pipe-like seat 9.

The peripheral wall of the liquid storing pipe 7 has an obliquity a (also referring to FIG. 5). One end of the liquid storing pipe 7 can be connected with the mouth 63 of the cap 6, while the other end thereof is provided with a valve port 72 for mounting the liquid suction valve 71.

Figure 6:
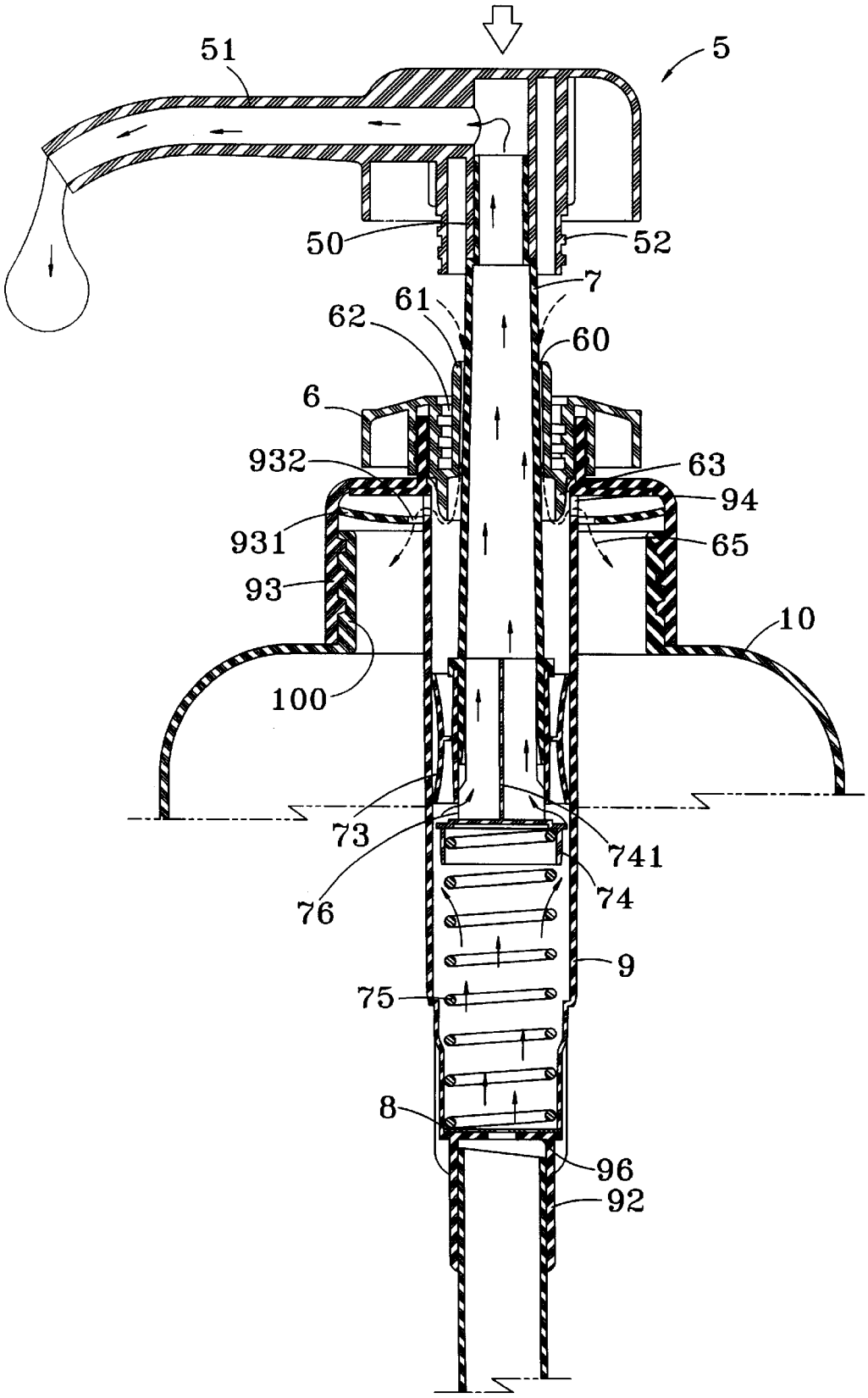
FIG. 6 is a sectional view showing a pressing state of the present invention.

The liquid suction valve 71 is comprised of a valve plug 74 and a valve sleeve 73 assembling therewith (as shown in FIG. 3). The valve plug 74 is loaded on one end thereof with the spring 75, and is provided on the other end thereof with a cross-shaped liquid guiding plate 741. The liquid guiding plate 741 can be connected to the valve port 72 of the liquid storing pipe 7 after slipping in the valve sleeve 73. So that the valve sleeve 73 can be freely moved up and down relative to the liquid guiding plate 741 to open and close the control valve for the cleaning liquid. And this (as shown in FIG. 5 and 6) can substitute the discharging bead.

The valve film 8 is made totally of PP and is provided with an inner C shaped ring (as shown in FIG. 3). The valve film 8 is placed in a horizontal wall section 96 of the pipe-like seat 9 to allow the valve film 8 to function as a one-way check valve for only discharging the cleaning liquid from the bottle (as shown in FIG. 5 and 6).

The pipe-like seat 9 is provided on one end thereof with a peripheral flange 91 and a threaded portion 95, while the other end thereof is provided with a liquid supplying pipe 92. A plurality of air holes 94 are provided beneath the peripheral flange 91. The horizontal wall section 96 is provided between the pipe-like seat 9 and the liquid supplying pipe 92 (as shown in FIG. 4). Wherein, the peripheral flange 91 can be fixed on the bottle mouth 100 on the top of the bottle 10 by rotational locking of the bottle cap 93 having a washer 931 (as shown in FIG. 5). The threaded portion 95 can be matched with the inner threaded portion 64 of the cap 6. The pipe-like seat 9 is installed therein with the liquid storing pipe 7 and the liquid suction valve 71, so that spring 75 of the liquid suction valve 71 can compact the valve film 8. The valve film 8 thereby can be elastically and firmly pressed on the wall section 96 having a reduced diameter (as shown in FIG. 5).

By assembling of the above stated members, the metered dispensing pump device of the present invention can be constructed. The peripheral flange 91 of the pipe-like seat 9 is mounted on the bottle mouth 100 on the top of the bottle 10 and is locked thereon with the bottle cap 93, the washer 931 then can tightly contact the bottle mouth 100 to totally seal the latter.

When in use, the liquid discharging cover 5 is screwed off (as shown in FIG., 5). And when the liquid discharging cover 5 is separated from the thread 62 of the cap 6, the liquid suction valve 71 can be pushed upwardly by the spring 75 to elastically raise the liquid storing pipe 7. The peripheral tapered wall of the liquid storing pipe 7 tightly contacts the tapered pipe 61 of the cap 6, so that exterior bathing water can not permeate into the bottle 10 even if it showers directly onto the liquid storing pipe 7. Therefore, the effect of preventing water from permeating into the bottle 10 can be achieved. When the liquid suction valve 71 is moved upwardly, the valve sleeve 73 thereof is moved downwardly to the position where the valve plug 74 locates at, then the valve sleeve 73 and the valve plug 74 tightly contact the inner wall of the pipe-like seat 9 to form a vacuum suction structure for drawing the liquid in the bottle 10. Thereby, the liquid in the bottle 10 flows through the liquid supplying pipe 92 to raise the valve film 8 and thus enters the pipe-like seat 9. When the spring 75 completely stretches to raise the liquid storing pipe 7 and tightly contact the tapered pipe 61 of the cap 6, the valve film 8 gets close tightly to the horizontal wall section 96 due to stopping of suction and weight of the liquid. Thereby a sealed state is formed and the pipe-like seat 9 is full of predetermined amount of liquid from the bottle 10 available for being taken for use by pressing. This is a ready state which is the normal state when the metered dispensing pump device has not yet been pressed down.

When the liquid discharging cover 5 is pressed down for taking liquid in the bottle 10 (as shown in FIG. 6), the liquid storing pipe 7 is pressed to carry the liquid suction valve 71 down to compress the spring 75 and extrude a predetermined amount of liquid. And the valve sleeve 73 moves up to form a liquid discharging annular gap 76 between itself and the valve plug 74, the obliquity a of the peripheral wall of the liquid storing pipe 7 and the mouth of the tapered pipe 61 are separated gradually to form an annular gap 60. The annular gap 60, the air holes 94 and a plurality of circling holes on the washer 931 form an air way 65 to communicate the external atmosphere with the interior of the bottle 10. So that air can enter the bottle 10 via the air way 65 to prevent forming of vacuum state induced by suction, and taking of liquid from the bottle 10 can be smooth. In this mode, even when the thread 62 is accumulated with bathing water in showering, the bathing water is impeded by the external wall of the tapered pipe 61 and is separated from the air way 65 by the difference of height "h" between the cap 6 and the tapered pipe 61. Thereby the problem that bathing water may flow into the bottle 10 to pollute the liquid therein can be solved, and water permeation can be prevented.

When the valve film 8 closes to tightly get close to the horizontal wall section 96 due to stopping of suction and weight of the liquid, a predetermined amount of liquid flows through the liquid discharging annular gap 76 and the cross-shaped liquid guiding plate 741. Liquid leading function of the cross-shaped liquid guiding plate 741 lead the predetermined amount of liquid into the liquid storing pipe 7 and discharge it out of the bottle 10 through the liquid discharging pipe 51. Thereby, taking of liquid from the bottle 10 can be effected (as shown in FIG. 6).

When the pressure on the liquid discharging cover 5 is removed, the liquid suction valve 71 is raised by the spring 75 and elastically move the liquid storing pipe 7 upwardly to again form a vacuum state for drawing liquid from the bottle 10. By aiding of the air way 65 which is communicated with the external atmosphere, the liquid drawn from the bottle 10 is supplied for the liquid supplying pipe 92 to raise the valve film 8 and thus enters the pipe-like seat 9. The pipe-like seat 9 is recharged with a predetermined amount of liquid from the bottle 10 and is ready for pressing to take the liquid.

In conclusion, the metered dispensing pump device preventable of water permeation of the present invention can effectively prevent permeation of external bathing water into the bottle 10 by water stopping of the tapered pipe 61 of the cap 6, and can protect the liquid in the bottle 10 from pollution of the bathing water.

Having thus described the technical structure of my invention with practicability and improvement, what I claim as new and desire to be secured by Letters Patent of the United States are:

1. A metered dispensing pump device comprising:

a liquid discharging cover, a cap, a liquid storing pipe, a liquid suction valve, a bottle cap, a spring, a valve film, and a pipe-like seat, wherein;

said cap is formed as an integral element, a first end of said cap is provided with a tapered pipe and a thread, while a second end of said cap is provided with a mouth and an inner threaded portion, said mouth is connected to one end of said liquid storing pipe, and said inner threaded portion is screwed in and locked onto a thread on said pipe-like seat so that said cap is screwed in and locked onto said pipe-like seat, a first end of said liquid storing pipe is extended through said cap to connect with said liquid discharging cover, and a second end of said liquid storing pipe is connected with said liquid suction valve, said liquid suction valve is loaded with said spring to firmly press said valve film onto said pipe-like seat, and a mouth of said tapered pipe is higher than said cap, said tapered pipe is separated from said thread of said cap and is in communication with said mouth of said cap, said thread of said cap can be locked onto said liquid discharging cover, and a groove is formed by said thread and is sealed on a bottom, and a peripheral wall of said liquid storing pipe has an obliquity, said peripheral wall tightly contacts the inner wall of said tapered pipe of said cap at positions away from said obliguity, said obliguity of said peripheral wall and said mouth of said tapered pipe on said cap form therebetween an annular gap.

* * * * *